United States Patent [19]

Reuter

[11] Patent Number: 4,581,869

[45] Date of Patent: Apr. 15, 1986

[54] PANEL CONSTRUCTION FOR AN OFFICE SYSTEM

[75] Inventor: Robert E. Reuter, Palm, Pa.

[73] Assignee: Knoll International, Inc., New York, N.Y.

[21] Appl. No.: 566,581

[22] Filed: Dec. 29, 1983

[51] Int. Cl.[4] ..... E04B 2/58; E04B 1/62

[52] U.S. Cl. ..... 52/475; 52/656; 52/785

[58] Field of Search ..... 52/656–658, 52/785, 823, 475–477, 802; 403/231, 402, 401

[56] References Cited

U.S. PATENT DOCUMENTS 1,036,439 8/1912 Brown ..... 52/657

2,173,649 9/1939 Firner ..... 52/823

FOREIGN PATENT DOCUMENTS 511824 8/1939 United Kingdom ..... 52/785

*Primary Examiner*—James L. Ridgill, Jr.

*Attorney, Agent, or Firm*—Guy W. Shoup

[57] ABSTRACT

Panel construction for an office system formed from a frame (18) defining the perimeter of a panel. A septum (14) having a central body portion (**14*b*) supported in a plane internal to the frame is used. The septum has an edge portion (14*d*) that forms an angle with respect to the central body portion of the septum (14*b*). The frame includes a septum support (18*c*) against which the septum edge portion (14*d*) bears. An outer skin (10) of the panel bears against the septum edge portion (14*d*) urging the latter against the septum support (18*c*). Frame pieces (18) are joined at corners by a clip (20) having first and second legs (20*b*) connected to corresponding first surfaces (18-1) of adjacent frame pieces. An intermediate web (20*a*) joins the legs (20*b*), and a tab (20*d*) is joined to the web (20*a*) for connection to corresponding second surfaces (18-2**) of adjacent frame pieces.

8 Claims, 5 Drawing Figures

PANEL CONSTRUCTION FOR AN OFFICE SYSTEM

BACKGROUND AND BRIEF DESCRIPTION OF THE INVENTION

This invention relates to office systems formed from interconnected panels, and has particular application to the construction of the panels in such systems.

Varying types of panel construction are known. Many are elaborate and involve a number of components, making panel fabrication difficult and expensive. The present invention is directed to simplifying the panel construction process and making it less costly.

In the present invention, a panel is constructed utilizing frame pieces that define the perimeter of a panel and which all have a common cross-section. The frame pieces are joined at corners to define a complete panel frame, and the joinder at each corner is achieved through use of a clip which has first and second legs that are adapted for connection to corresponding first surfaces of adjacent frame pieces. An intermediate web joins the legs of the clip, and a tab is joined to the web that is connected to corresponding second surfaces of adjacent frame pieces. In this fashion, the frame pieces are securely joined together at the corners of the frame. Additionally, the intermediate web of the clip that joins the clip legs closes off an opening to the interior of the panel provided at the corner joinder of adjacent frame pieces. Still further, the intermediate web of the clip is joined to the clip legs by a fold of material to form bearing surfaces at the folds, useful in joining adjacent panels together.

The panel includes a septum having a central body portion that is supported in a plane internal to the frame. The septum has an edge portion that forms an angle with respect to the central body portion. The perimeter frame includes a septum support against which the septum edge portion bears, and an outer skin of the panel bears against the septum edge portion and urges that septum edge portion against the septum support to hold the septum securely in place within the frame. The panel preferably includes an outer skin on each side thereof, and ribs internal to the panel on both sides of the septum central body portion. The ribs maintain the outer skins in spaced relationship to each other and to the septum central body portion. Sound dampening material advantageously may be positioned between the septum and the outer skin, as desired, for sound control purposes.

A durable panel is thus provided which is simple to fabricate, is relatively inexpensive when compared with other panel configurations presently on the market.

The invention will be more completely understood by reference to the following detailed description of a representative but presently preferred embodiment of the invention.

DETAILED DESCRIPTION

Figure 1:
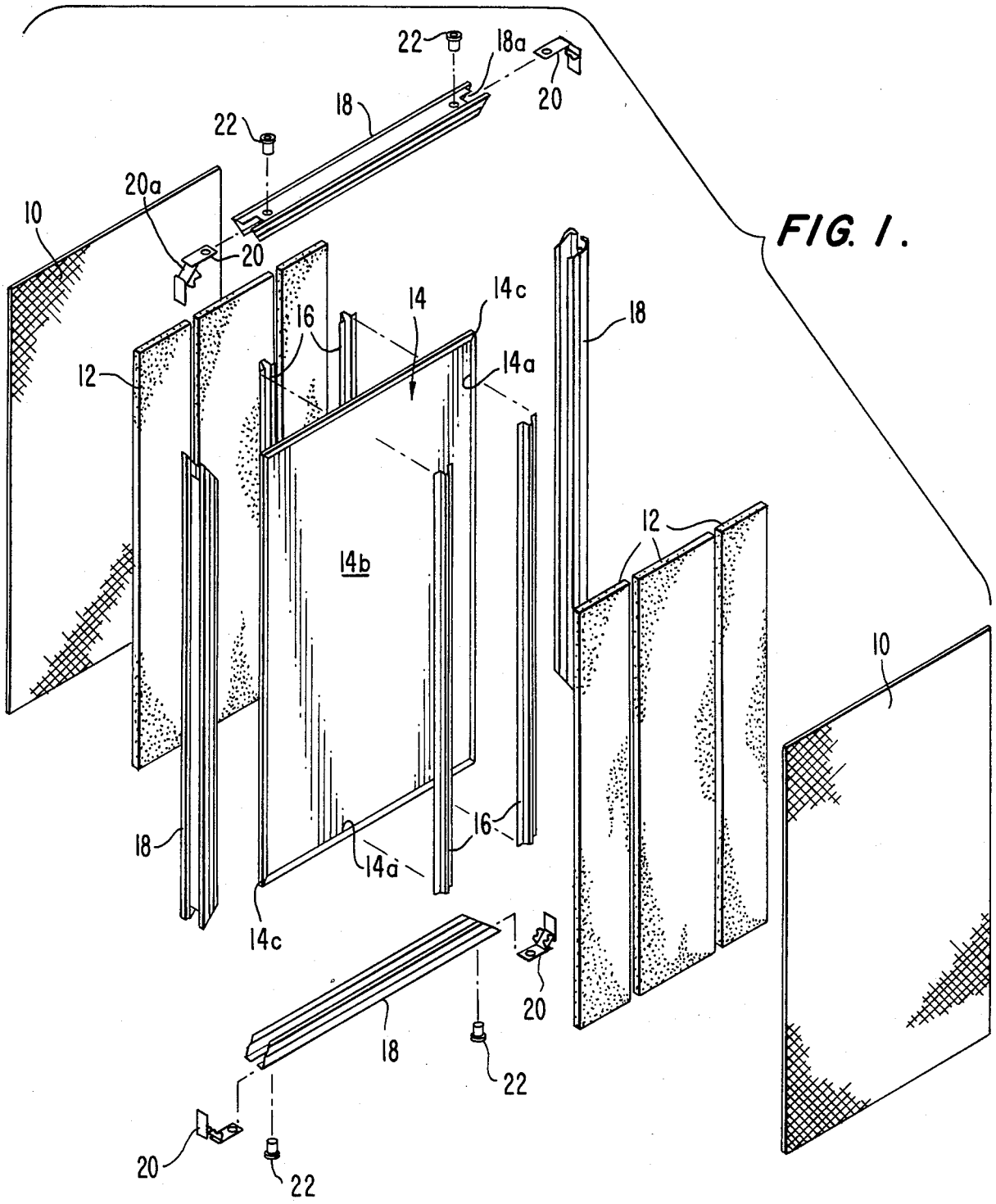
FIG. 1 is an exploded view of a panel embodying the invention.

Referring to FIG. 1, the parts involved in the construction of a panel are expanded steel skins 10, sound dampening material 12 (if desired, such as of Fiberglas or other accoustical fill material for sound absorption), an internal septum 14, reinforcing ribs 16, frame pieces 18 of a perimeter frame, corner clips 20 used to join together adjacent frame pieces at the corners of the frame, and fasteners 22 used to join together the corner clips to the frame pieces. The septum 14 is preferably of cardboard or other similar rigid material which may be creased, as at 14*a*, to permit the edges of the septum 14 to form an angle with respect to the central body portion of the septum, designated 14*b* in FIG. 1. The four corners of the septum are notched, as at 14*c*, to permit all perimeter edges of the septum to be bent along the crease lines 14*a* so that all edges may form such an angle with respect to the central body portion 14*b* of the septum.

As shown in FIG. 1, the frame pieces 18 are notched at their ends, as at 18*a*. These notches permit adjacent frame pieces to be held together by the clip 20, which includes an intermediate web 20*a* which extends into the region of the frame piece cutout 18*a*, as will be explained in more detail below.

In practice, the four frame pieces 18 are first joined together through the use of the clips 20 to construct a frame that defines the perimeter of the panel. The clips 20 are joined to the frame pieces 18 by fasteners, such as those designated 22 in FIG. 1, which may be threaded through the clip into the frame pieces. When the frame pieces and clips are made of metal, these clips may be joined to the frame pieces by spot welding, as desired. As shown in FIG. 1, the clips each would be held to one of two adjacent frame pieces by use of fasteners 22; each clip would be held to the adjacent frame piece by spot welding, for example.

Figure 2:
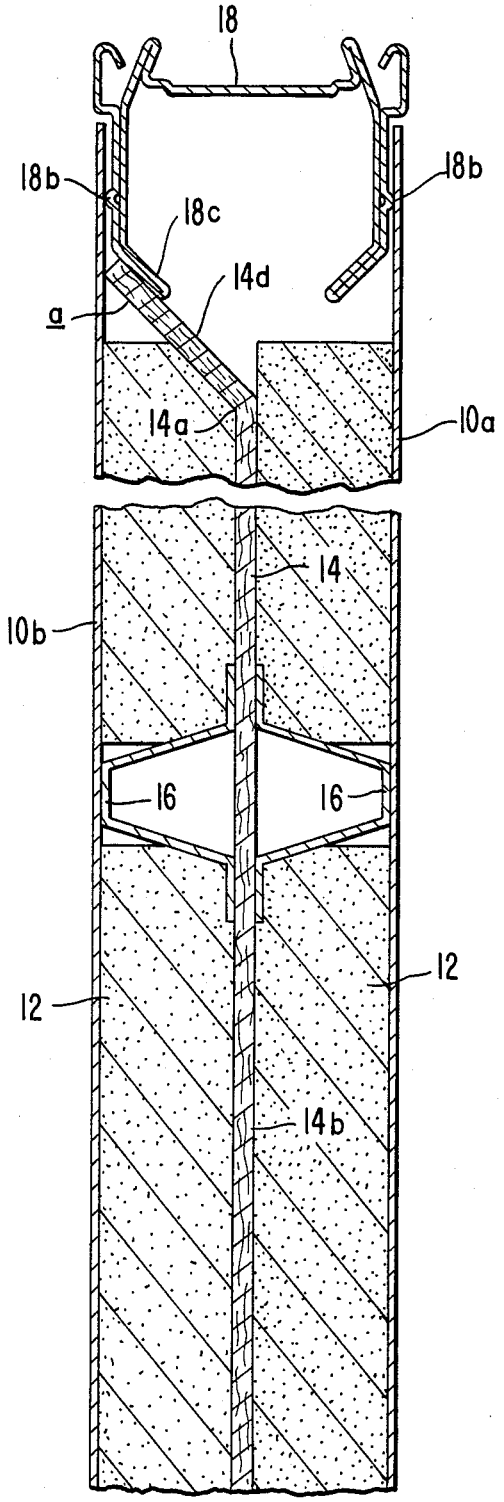
FIG. 2 is a sectional view of a part of a panel formed from the components of FIG. 1.

Once the basic frame has been assembled, utilizing the frame pieces 18 and clips 20, one of the expanded steel outer skins 10 is attached to the frame, for example by spot welding to that frame. FIG. 2 shows expanded steel outer skin 10*a* in position against the frame piece 18, attached by spot welding to protrusion 18*b* along the face of the frame piece.

Next, a subassembly of septum 14, ribs 16 on both sides of the septum, and sound dampening material 12 on both sides of the septum is positioned within the frame against the outer skin 10*a*. In this case, the subassembly just mentioned is pre-formed by bonding the ribs to the septum, and the sound dampening material to the septum as well, through use of glue or other suitable fastening/adhesive material. When the subassembly is inserted into the frame, edge portion 14*d* of the septum, defined by the perimeter crease line 14*a*, bears against septum support 18*c* that forms a part of the frame piece. The septum support 18*c* extends inwardly at and angle substantially the same as that of the septum edge portion 14*d*. Thus, the edge portion 14*d* of the septum bears against the septum support 18*c* and is held in place by outer skin 10*b* which is bonded to the perimeter frame piece 18, as by welding to the projection 18*b* along the frame piece, to complete the panel assembly. In other words, the edge portion –*d* of the septum is captured in the acute angle a defined by the septum support 18*c* and the outer skin 10*b*.

Thus, as shown in FIG. 2, the central body portion 14*d* of the septum is supported in a plane internal to the frame defined by the frame pieces 18. The edge portion 14*d* of the septum forms an angle with respect to the septum central body portion 14*b*. The septum support 18*c*, forming a part of the frame piece 18, aids in the central positioning of the septum, and the support ribs 16 maintain the outer skins 10*a* and 10*b* in spaced relationship to each other and to the central body portion 14*b* of the septum. A unique panel configuration is thereby produced, easy to assemble, as just described, and economical to manufacture.

Figure 3:
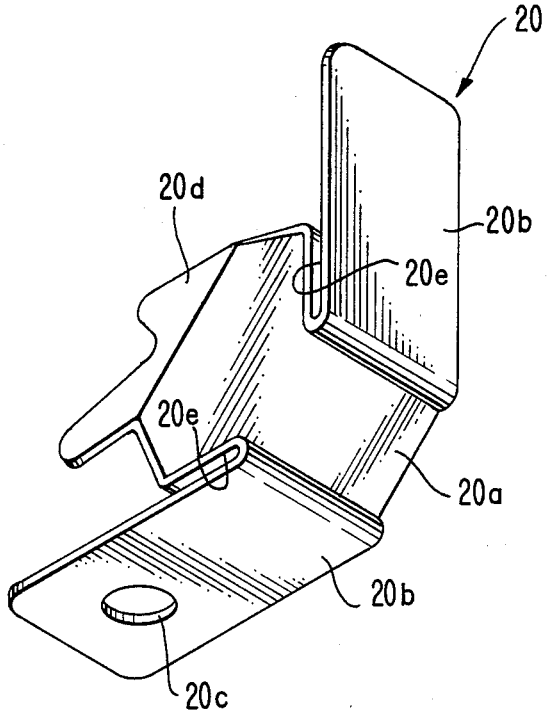
FIG. 3 is a perspective view of a clip embodying the invention and used to join adjacent frame pieces.

FIG. 3 shows in greater detail one of the clips 20 used to join adjacent frame pieces 18 together. That clip is composed of two legs 20*b* (in planes at right angles to each other in a frame having right-angled corners), an intermediate web 20*a* that joins together the clip legs. One or both of the clip legs 20*b* may be drilled, as at 20*c*, to permit a fastening element 22, as shown in FIG. 1, to pass therethrough. In FIG. 3, only one of the legs is shown as including a hole 20*c*. In this case, the other leg is advantageously welded to a frame piece, as described above, although screw-type or other suitable fastening of clip leg to frame piece may be employed.

The intermediate web 20*a* has tabs joined thereto, only one of which is shown in FIG. 3 and which is designated 20*d*. The tabs 20*d* (in planes parallel to each other and perpendicular to the planes of the clip legs 20*b*) are used to fasten the clip 20 to adjacent surfaces of adjacent frame pieces. Thus, with reference to FIG. 4, the clip legs 20*b* are attached to corresponding first surfaces 18-1 of adjacent frame pieces 18 at a corner of the frame in a panel. Clip tab 20*d* is connected to corresponding second surfaces 18-2 of adjacent frame pieces, e.g., by being spot welded thereto. In this fashion, the frame defining a panel is rigidly formed by the clips 20.

The intermediate web 20*a* that forms a part of the clip closes off the opening at the corner to the interior of the panel provided by the cut-away portions 18*a* (FIG. 1).

The clip 20 is preferably formed by joining the intermediate web 20*a* to the clip legs 20*b* by a fold of material, as at 20*e* in FIG. 3. This fold provides a bearing surface as will be explained with respect to FIG. 4.

Figure 4:
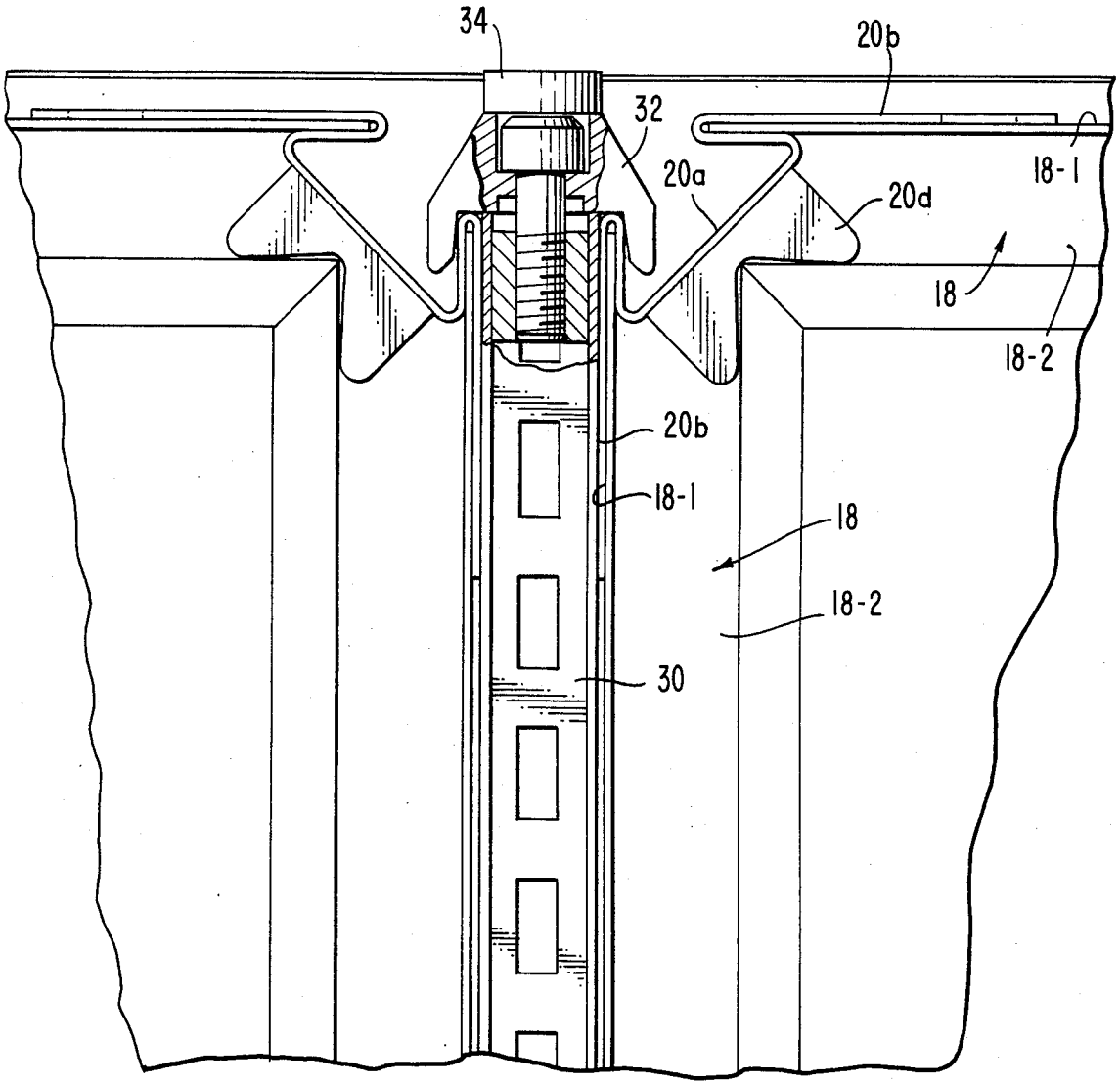
FIG. 4 is a front view of two adjacent panels in accordance with the invention held together by a clamping-/wedging action via an intermediate cantilever support element.
Figure 5:
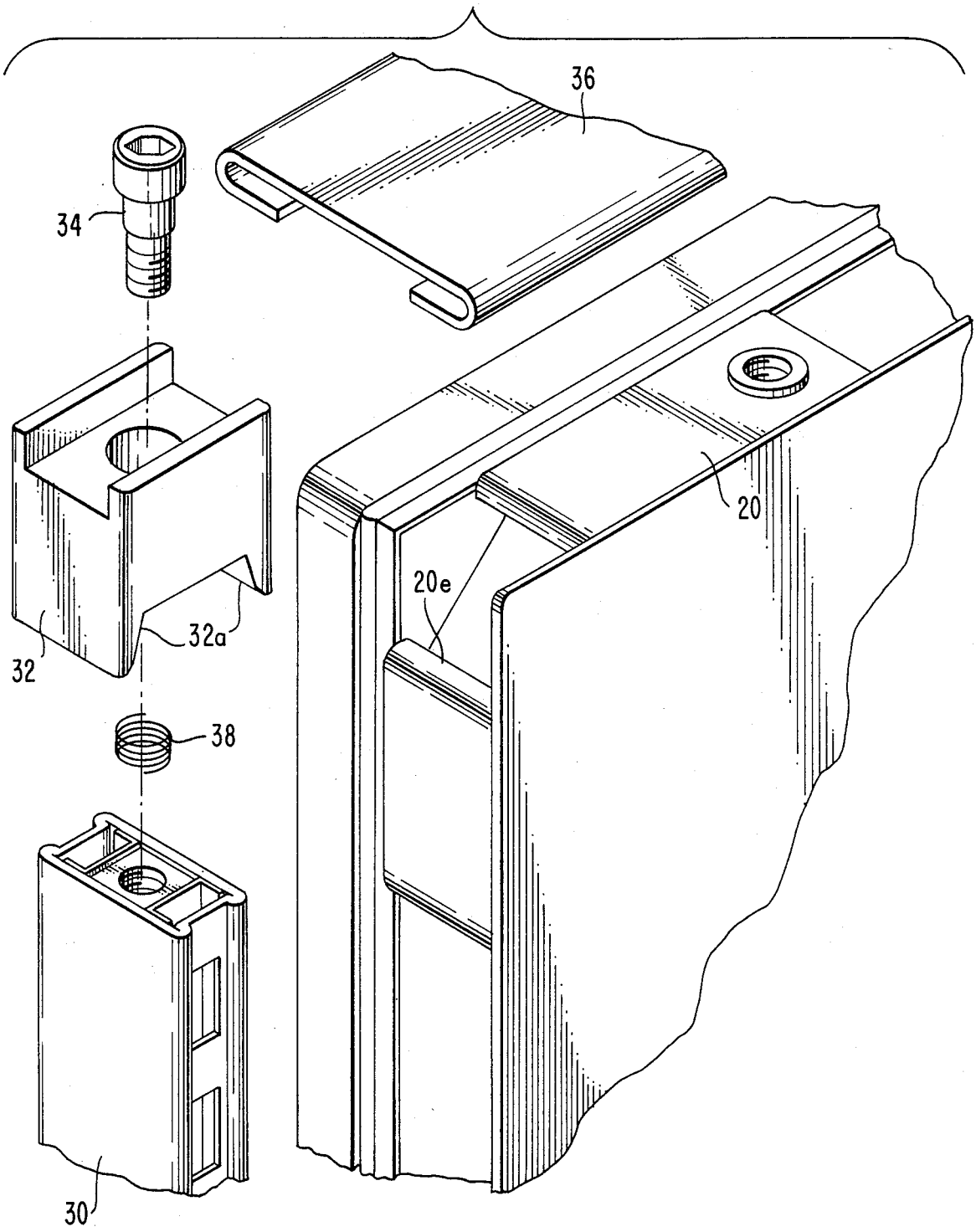
FIG. 5 is an exploded view showing in greater detail the parts involved in the joining of the panel embodying the invention to an adjacent cantilever support element.

In particular, FIG. 4 shows two adjacent panels joined together in side-by-side fashion through use of an intermediate cantilever support element 30. A wedge block 32 is employed held to the cantilever support element 30 by a screw 34. Refer also to FIG. 5, which shows one-half of the arrangement of FIG. 4 in exploded view. It will be noted particularly from FIG. 5 that the wedge block 32 includes inclined surfaces 32*a*. One of the surfaces 32*a* bears against the clip 20, and particularly the folded-over bearing surface 20*e*, drawing the clip against the cantilever support structure 30. These features of cantilever support member and wedge block form a part of the invention of Andrew I. Morrison, disclosed and claimed in copending U.S. Pat. application Ser. No. 560,877 for SPACE DIVIDER SYSTEM, filed 13 Dec. 1983. Also shown in FIG. 5 are a top cap 36 and retraction spring 38, not forming a part of the present invention.

It will be appreciated that modifications of the specific embodiments of the present invention that are presently preferred and which have been disclosed above may be made by those skilled in the art. Accordingly, the invention should be taken to be defined by the following claims.

What is claimed is;

1. In panel construction for an office system including a frame defining the perimeter of a panel, the improvement comprising a septum having a central body portion supported in a plane internal to said frame, said septum having an edge portion forming an angle with respect to said central body portion, said frame including a septum support extending inwardly of the panel at an angle generally the same as that of said septum edge portion and against which said septum edge portion bears, and an outer skin of said panel defining an a cute angle with said septum support, said septum edge portion being captured within said acute angle.

2. Panel construction as in claim 1, wherein said panel includes an outer skin on each side thereof, and ribs internal to said panel on both sides of said septum central body portion maintaining said outer skins in spaced relationship to each other and to said septum central body portion.

3. Panel construction as in claim 2, including sound dampening material positioned between said septum and said outer skins.

4. Panel construction as in claim 1, in which said frame is formed of separate frame pieces joined at corners, the joinder at each corner being achieved by a clip, said clip having first and second legs adapted for connection to corresponding first surfaces of adjacent frame pieces, an intermediate web joining said legs, and a tab joined to said web and adapted for connection to corresponding second surfaces of adjacent frame pieces.

5. Panel construction as in claim 4, in which said intermediate web closes off and opening to the interior of said panel provided at the corner joinder of said adjacent frame pieces.

6. Panel construction as in claim 4, in which said web is joined to said legs by a fold of material constituting said clip to form bearing surfaces at said folds.

7. Panel construction for an office system comprising a frame defining the perimete of a panel, an internal septum closing off the open space internal to the frame, reinforcing ribs on both sides of said septum, sound dampening material on both sides of said septum, and outer skins on both sides of said septum bearing against said frame and said reinforcing ribs and said sound dampening material.

8. Panel construction according to claim 7, in which said outer skins are of expanded steel.

* * * * *